US006253864B1

(12) United States Patent
Hall

(10) Patent No.: US 6,253,864 B1
(45) Date of Patent: Jul. 3, 2001

(54) PERCUSSIVE SHEARING DRILL BIT

(76) Inventor: David R. Hall, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 09/131,592

(22) Filed: Aug. 10, 1998

(51) Int. Cl.[7] ..... E21B 10/36

(52) U.S. Cl. ..... 175/415; 175/414; 175/418; 175/429

(58) Field of Search ..... 175/296, 306, 175/414, 417, 420.1, 415, 418, 429

(56) References Cited

U.S. PATENT DOCUMENTS

| | | | | |
|---|---|---|---|---|
| 4,096,917 | * | 6/1978 | Harris | 175/418 |
| 4,210,316 | * | 7/1980 | Hall | 175/306 |
| 4,771,834 | * | 9/1988 | Treitz | 175/417 |
| 4,940,097 | * | 7/1990 | Martini | 175/417 |
| 5,199,512 | * | 4/1993 | Curlett | 175/418 |
| 5,291,957 | * | 3/1994 | Curlett | 175/418 |
| 5,305,837 | * | 4/1994 | Johns et al. | 175/296 |
| 5,360,076 | * | 11/1994 | Kelly, Jr. et al. | 175/371 |
| 5,794,728 | * | 8/1998 | Palmberg | 175/418 |

FOREIGN PATENT DOCUMENTS

| | | | | |
|---|---|---|---|---|
| 1097920 | * | 1/1961 | (DE) | 175/296 |
| 2242464 | * | 10/1991 | (GB) | 175/417 |

* cited by examiner

*Primary Examiner*—Lanna Mai
*Assistant Examiner*—Elaine Gort

(57) ABSTRACT

A drill bit that combines the forces of high rotational torque and percussive impact with impact-resistant shear cutting inserts in order to increase formation penetration rates, particularly in deep wells were borehole pressure is high. The drill bit may also be used in cooperation with high-pressure jets that augment penetration, cool the shear cutting inserts, and remove the chips.

19 Claims, 10 Drawing Sheets

PERCUSSIVE SHEARING DRILL BIT

BACKGROUND

This invention relates to the field of drilling wells for oil, natural gas, water, utilities, or geothermal energy. Specifically, the invention is a new type of drill bit that transmits both rotational torque and axial impacts to the formations to be penetrated. In the most preferred embodiment, this bit may be further enhanced by medium to high-pressure fluid jets; the jets may be steady or pulsed that cause zones of high and low pressure near the cutters on the contact surface of the formation being drilled. A vast majority of drill bits currently on the market for subterranean applications fall into three categories: shear or drag bits, percussive bits, and roller cone or tri-cone bits. Shear bits are typically rounded at the penetrating end with cutters mounted in an orientation nearly normal to the wall of the borehole. Typically, these bits are threaded into the bottom of a drill string, and are rotated against the rock formation from either the top of the hole or down-hole by rotary motors. Such bits have fluid channels extending along the length of the bit body to carry drilling fluid past the cutters and further up the drill string. See U.S. Pat. No. 4,554,986, U.S. Pat. No. 5,284,215, U.S. Pat. No. 4,696,354, U.S. Pat. No. 4,744,427, and U.S. Pat. No. 4,655,303 for examples of this type of bit. Percussive bits are usually flat on the penetrating surface with rounded cutters protruding outwards to concentrate compressive stresses in the rocks upon impact. A unitary body (absence of threaded connections, moving parts, etc) helps transmit an impact stress from the top of the bit (where impacts are imparted) to the bottom contact surface (where it meets the rock) without significant attenuation. Such a bit is usually slidably mounted to the bottom of a drill string, and is keyed to allow rotation of the bit during drilling. The drill string rotates primarily to index the cutters of the percussive bit to a fresh cutting surface between impacts, thereby preventing regrinding of previously crushed material. Roller cone bits normally have three smaller conical bits oriented outwards; each conical bit rotates about its own axis to produce eccentric cutter motion in addition to the overall rotation of the bit. See U.S. Pat. No. 5,624,002 for an example of a roller cone bit.

Drilling induces two types of stress on the rocks. Rotational drilling causes a buildup of shear stresses in the rock; the stresses concentrate to cause a thin layer of rock to shear and break into chips. Percussive drilling, on the other hand, causes compressive stresses where the rounded cutter strikes the rock. Cracks propagate from the point of impact, once again chipping the rock. Roller cone bits induce stresses similar to those of a rotational bit with the addition of a slight percussive element as the cutters rotate on each individual cone. For fairly shallow applications, or in applications where air is used as the drilling fluid, percussive drills have a much faster drilling rate than shear or roller cone bits. Percussive bits also tend to drill straighter than their rotary counterparts. However, in deeper holes, the higher pressure of the drilling fluid will tend to hold the rock chips in place in the absence of significant shear forces; thus, percussive bits lose some of their advantage in deeper holes. In addition, percussive bits lose some of their advantage in softer, less friable formations. Many such formations are typically found interbedded with harder formations while drilling a well. Hence, drilling by percussive means alone may not be optimal for all portions of a well.

The amount of weight allowed to press on the bit is also a factor in determining the penetration rate. Flathead percussive bits are currently operated with only about 5,000 pounds of weight on bit. At higher weight on bit, large shear loads are generated, against which this type of bit is not well adapted. As a result of high shear forces, the rounded cutting elements, or even the head of the bit will typically break. Roller cone bits, on the other hand, are typically used at weights on bit of 20,000 to 50,000 pounds. Drag bits are typically used at somewhat lower weights on bit, on the order of 10,000 to 25,000 pounds. The shape and orientation of the cutters in these bits is conducive to a rotary cutting motion so that the shear stresses do not break the body of the bit or the cutters.

A further difference between the bit classifications mentioned above can be noted by considering the mode of wearing of the cutters. For percussion and roller-cone bits, the cutters ideally do not wear appreciably during operation. If such wear occurs, penetration rate drops dramatically. To enable improved life of these bits, a thin layer of polycrystalline diamond is often applied to the entire exposed surface of the cutters, preventing substantial wear over the life of the bit. Shear bits are likewise enhanced with a thin layer of polycrystalline diamond on the cutter surface. However, the region of the cutter directly behind the polycrystalline diamond layer is typically left unprotected and exposed to abrasion by the rock formation being penetrated. As drilling progresses, the region directly behind the polycrystalline diamond layer wears, exposing a sharp lip of polycrystalline diamond. This feature is known in the industry as "self-sharpening" of the cutters. Hence, percussion and roller-cone bit cutters are designed to operate in a non-wearing mode; shear bit cutters are typically designed to operate in a wearing mode. In spite of the benefits claimed by self-sharpening cutters, it would be advantageous for a shear bit to operate in non-wearing mode, if it were possible to provide a polycrystalline diamond layer robust enough to avoid appreciable wear. Such a bit would drill faster than current art shear bits because it would pose an overall sharper cutter profile to the rock. To induce even faster cutting, a third cutting medium can be utilized in combination with rotation and percussion: medium- or high-pressure fluid jets. Testing indicates that such jets may enhance rotary and percussive drilling rates by acting cooperatively with the mechanical rock-breaking action of such bits. When jets are directed to impinge upon the rock formation near the point of penetration, or just in front of the cutters, they remove the crushed rock underneath the advancing cutters causing more rapid and deeper penetration into the formation.

Another phenomena associated with the high-pressure fluid jets occurs in their identity with underbalanced drilling.

Underbalanced drilling (UBD) is a complex technique that has gained popularity over the past 10 years because of its advantages to reduce formation damage, avoid lost circulation, minimize differential sticking, and increase the penetration rate and bit life. The objective of the technique is to cause a hydrostatic pressure differential between the formation being drilled and the wellbore.

The mechanics of a UBD operation consist of drilling fluids (liquid, gasified liquid or foam) pumped down inside the drillstring, through the downhole drilling motor and bit, and then up the annulus. In the annulus, the drilling fluid may be mixed with drilled cuttings, production gas, formation oil, or water, and gases injected into the annulus. The fluid mixture then flows out of the well through a choke.

In UBD the hydrostatic pressure throughout the drilling operation is maintained at a lower level than that in the formation being drilled. This is achieved through the medium of the drilling fluid with such complex drilling restrictions taken into account as: mud density, densities of lift gases, densities of produced gases, free gas transport, cuttings velocity, injection gas rates, production from the reservoirs, drilling fluids rheology, frictional pressure losses, and localized pressure losses.

Additionally, a UBD operation is dynamic by nature. Factors that cause dynamic effects include: changes in the pumping rate of drilling fluid; changes in gas injection rate; changes in production rate due to wellbore pressure changes and/or local reservoir pressure depletion; changes in production rate due to increasing open hole length; drill string movement; pipe connections; and other unexpected events, e.g. interruption of supply of Nitrogen.

Because UBD affects the entire drilling operation careful planning is required to avoid dynamics detrimental to the drilling operation. An overbalanced or hazardous underbalanced condition may result in destabilization, or even catastrophic failure, of the drilling operation. Moreover when destabilization occurs, it can take a long time from when a change in flow is first detected until the flow has stabilized again; and if the disturbances are frequent, a stationary condition may never be reached.

High pressure jets have the capacity to add some of the benefits of underbalanced drilling to the percussive shearing bit of the present invention without the dynamic limitations. The high-pressure jets are believed to simulate the hydrostatic pressure differential characteristics present in UBD. The underbalanced condition is achieved locally without the dynamic limitations, complexity, and added expense of the traditional system. The jets increase hydrostatic pressure in cracks created by the shear and compressive cutter action in the formation. At the same time, the velocity of the jet stream moving across the face of the rock causes a zone of low pressure locally in the wellbore around the point of contact with the bit cutters. The resulting pressure differential promotes rapid chip formation and removal, increasing the cutting efficiency of the bit and its rate of penetration.

The fluid jets also serve to carry heat away from diamond cutters. Heat that is generated by the cutting action of the cutters has been identified as a major cause of cutter failure by causing the diamond table to decompose or delaminate. The jetting action around the cutters efficiently removes the chips and circulates fluid past the cutters thereby carrying away heat and prolonging the life of the diamond coated cutters.

In light of these factors, it is desirable to create a bit which can subject the rock to shear and percussive-compressive stresses, as well as high-pressure jetting. Such a bit would have the advantages of a percussive bit; it would drill rapid, straight holes. In addition, the bit would be capable of maintaining a rapid drilling rate in deeper holes because of the greater weight on the bit and the shear-inducing cutters. Rotation and percussion are powerful when they act together on rock formations because while percussion effectively induces cracks into the rock formation, the shear cutting action will remove the chips regardless of the fluid pressure acting on the rock surface. A jet-assisted bit would further assist in increasing penetration rate and prolonging the life of the cutters through efficient chip removal and cooling.

The implementation of these technologies requires a new bit design. This bit must successfully transmit percussive, shear and steady axial forces to the rocks. In addition, the cutters must be specially designed and oriented to both scrape and impact the rock without breaking. Finally, medium to high-pressure jets must be properly integrated into such a bit to provide for maximal drilling benefits.

SUMMARY

This invention is a new drill bit that combines rotary and percussive motion, which can be further enhanced with high-pressure fluid jets, to penetrate subterranean formations more effectively. The bit includes a striking surface for use with a fluid-driven percussive piston such as those disclosed in U.S. Pat. No. 5,396,965, U.S. Pat. No. 5,488,998, and U.S. Pat. No. 5,497,839. The piston provides percussive force; the torque can be supplied by a known method such as surface-mounted turntable or top drive or a down-hole rotary motor. Weight on bit for rotary mode drilling may be provided by the weight of the drill string, or by a thruster located at the surface or down-hole, and is transmitted to the bit by means of an up-hole facing shoulder on the bit. The bit attaches to the drill string by way of an adjustable grip, ratchet, cam, or keyways so as to allow both the torque and the linear motion to be transmitted from the drill string to the bit. Cutting elements comprising superhard materials are arrayed along the head of the bit. These cutting elements may be arrayed in a random fashion, or may be aligned so as to create one or more axially oriented blades on the surface of the bit.

In a preferred embodiment, the bit is further enhanced by high-pressure fluid jets. The jets are directed to impinge on the formations being penetrated by each cutter, and are continuous or timed to pulse during percussion and immediately thereafter to remove chips most effectively.

The cutters on the bit comprise a hard substrate and a cutting surface composed of a superhard material such as polycrystalline diamond, natural diamond, tungsten carbide, or cubic boron nitride. The cutting surface extends over the edge of the substrate to protect it and form a more secure bond. By so extending the cutting surface, all exposed regions of the cutters are protected against wear; thus, unlike a typical shear cutter, the cutter is designed to operate in non-wearing mode. The design of the cutters may vary depending on the nature of formation being penetrated, and may comprise designs known in the art such as a disk, a cylinder, a cone, a truncated cone, a tooth, and/or a plow shaped cutter. In addition, the cutting surface is bonded to a number of composite layers which separate it from the substrate material; these layers provide a steady gradient in changing material properties from the cutting table to the substrate, thus decreasing the stress on the bonds. In a preferred embodiment, the interface between the substrate material and the cutting surface is additionally non-planar to enhance attachment and strength of the cutting table to the substrate. The cutters are oriented along the operative surface of the bit at a rake angle greater than 25 degrees so as to wear well under percussion as well as rotary shear.

Additionally, the shearing and percussive action of the bit may be augmented by formation indenting elements disposed ahead of the cutting elements. The indenting elements comprise a domed or hemispherical operative surface of superhard material bonded to a hard substrate. The bit's percussive action drives the indenting element into the formation, fracturing it ahead of the high-pressure jets and the shear cutters. The synergy of the indenting elements, the high-pressure jets, and the shear cutters results in more efficient bit action and higher rates of penetration in medium to hard formations.

DETAILED DESCRIPTION

Brief definitions of some of the terms to be used in the descriptions will herein be provided. Percussive shearing refers to the capability of the cutters to effectively penetrate subterranean formations with simultaneous rotational shearing forces and axial impact forces. The unitary bit is understood to be either constructed of one piece of material or a plurality of pieces that do not move with respect to each other. The striking surface is a part of the bit with a structure strong enough to receive and transmit axial impact forces. Though in its strictest sense, parabolic refers to the mathematical function defining a curve that, at all points along the curve, is equidistant from a line and a point, the description of the bit head as being parabolic refers only to a generalized shape. The cutting table is the part of the cutter that is oriented outwards from the bit so as to contact the subterranean formation. The rake of the cutting element is the angle of the cutting surface with respect to a line normal to the surface to be cut. A hammer is any fluid-actuated down-hole piston used to transmit percussive energy to the bit. Actuating fluids may include, but are not limited to, air, water, brine, water- and oil-based drilling muds, and aqueous foams. The head of the bit is the part on which the blades and/or cutting elements are mounted; the shank is the reduced segment that fits inside the drill string.

Figure 1A:
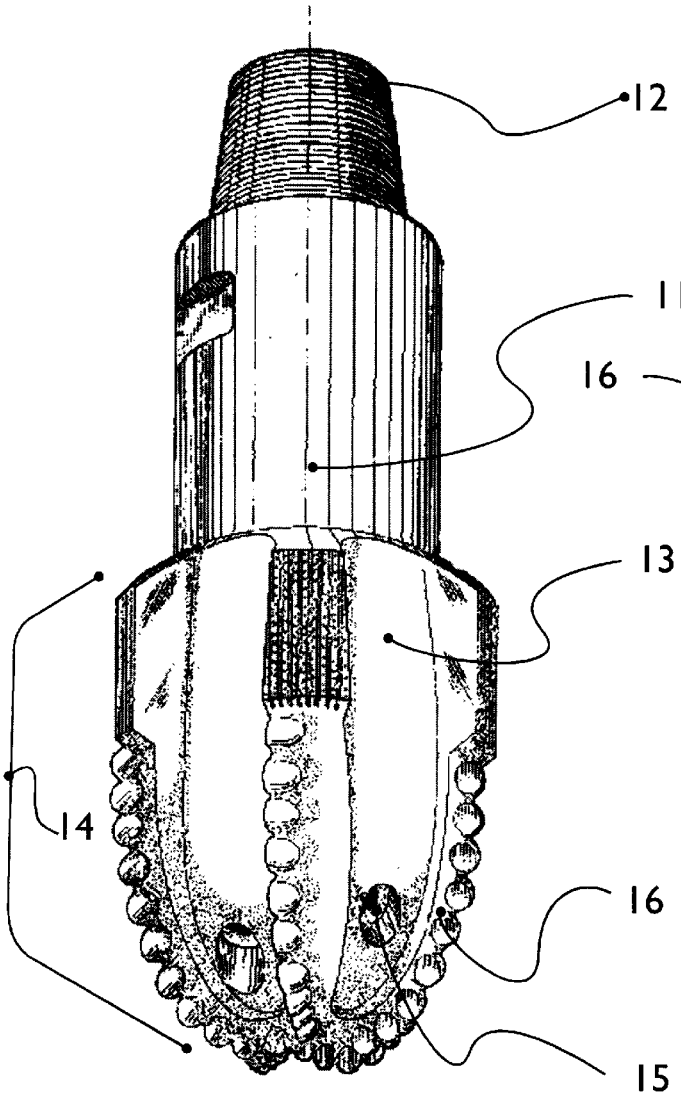
Figure 1A (Prior Art)
FIG. 1A is a drawing of a prior art rotary drill bit.
Figure 1B:
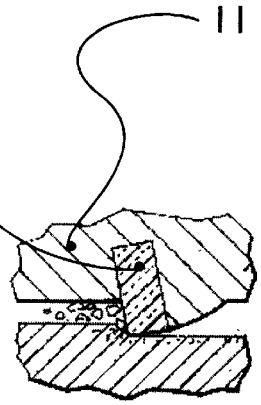
Figure 1B (Prior Art)
FIG. 1B shows a cutting element from a typical rotary drill bit with a small rake angle.

FIG. 1A depicts a rotary drill bit representative of the prior art. The threadform 12 on shank of bit 11 provides a means of attachment to the drillstring, and allows torque to be transferred to the bit. The longitudinal slots 13 in the parabolic head of the bit 14 serve to allow up-hole passage of drilling fluid that exits the interior of the bit through the passageways 15 in the head of the bit. Rock chips are removed from the hole bottom by becoming entrained in drilling fluid exiting through these slots. Cutting elements 16 are positioned such that they will induce shear stresses in the formation around the bore; primary cutting forces act nearly parallel to the surface of the formation. FIG. 1B shows the rake angle of the cutting elements 16, which is typically around 20° (nearly normal to the surface of the rock). This rake angle has been found to provide maximal penetration rate for drag mode drilling; higher rake angles are not found in practice because such slow the rate of drilling.

Figure 2:
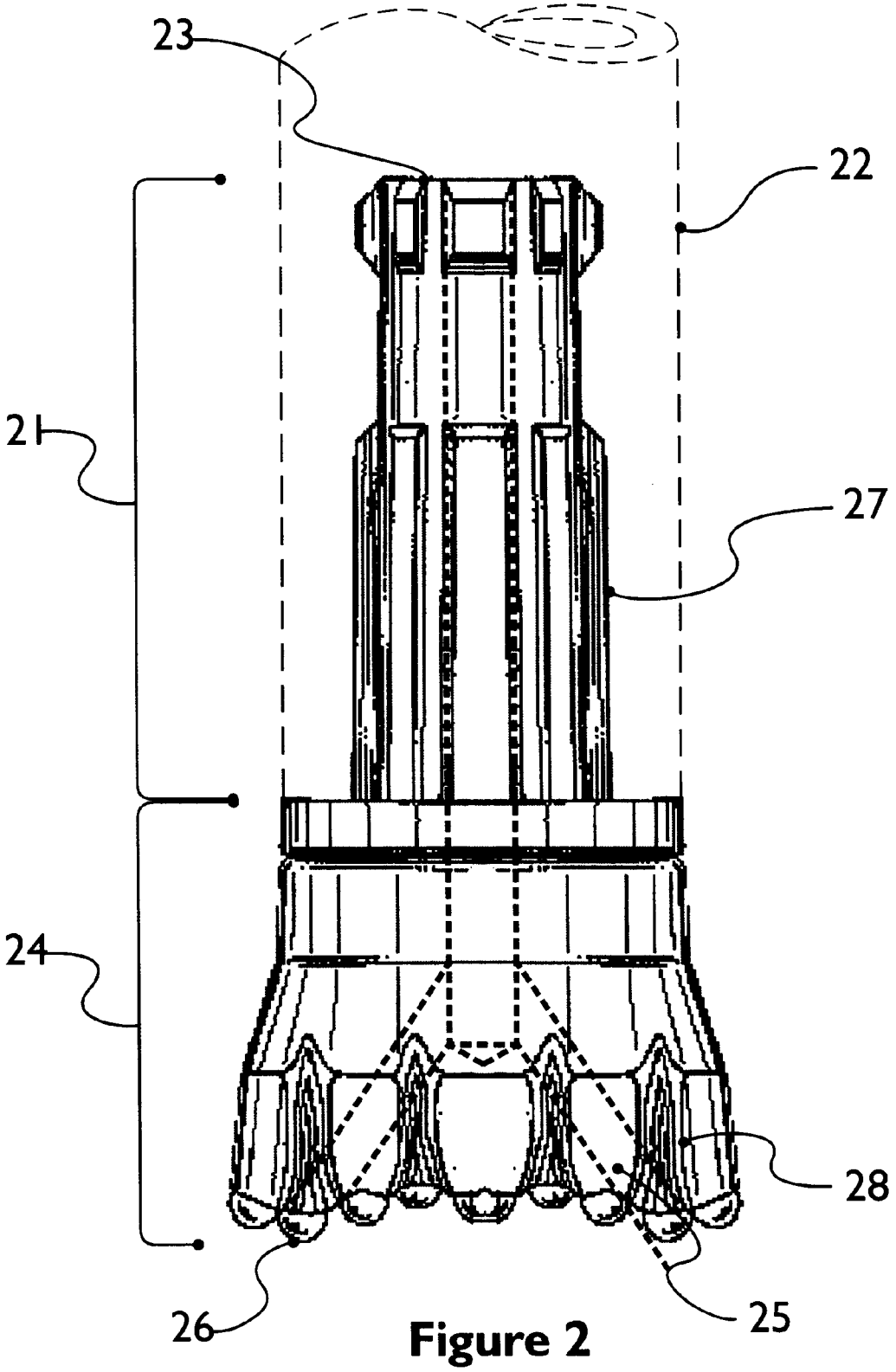
FIG. 2 is a drawing of a prior art percussive drill bit.

FIG. 2 depicts a percussive drill bit representative of the prior art. Shank 21 is specially adapted to fit inside the drill string 22 and surface 23 receives impacts from a reciprocating hammer housed within the drill string. Head 24 is substantially flat or concave conical; slots 28 and passageways 25 have a function similar to slots 13 and passageways 15 in FIG. 1. Head 24 contains a plurality of dome-shaped cutting elements 26 arrayed about its face. The shape and orientation of head 24 and cutting elements 26 are adapted to transmit cutting loads to the subterranean formation in a direction very nearly normal to the surface of the formation. Spline 27 serves to couple drill string 22 and shank 21 rotationally, such that cutting elements 26 can be moved to a fresh cutting surface by rotating the drill string.

Figure 3:
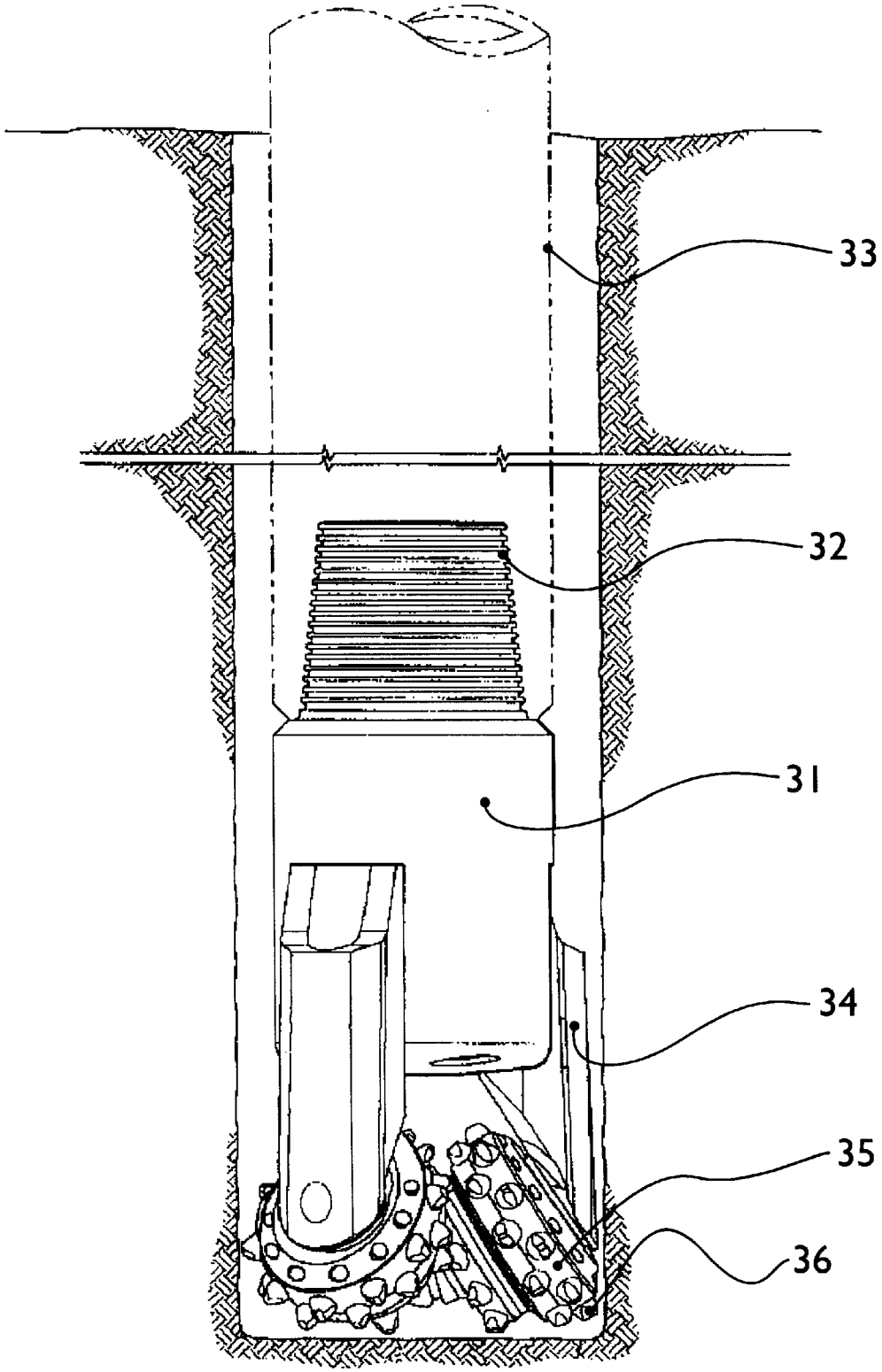
Figure 3 (Prior Art)
FIG. 3 is a drawing of a prior art roller-cone bit.

FIG. 3 depicts a roller-cone drill bit representative of the prior art. Threaded connection 32 on bit body 31 provides a means of attachment to the drill string 33, and allows torque to be transferred to the bit. Lugs 34 support roller cones 35 that house a plurality of chisel-like cutting elements 36. As torque is applied to the drill string, the roller cones rotate in an eccentric path combining a slight percussive action with its shear force in order to cut into the formation.

Figure 4:
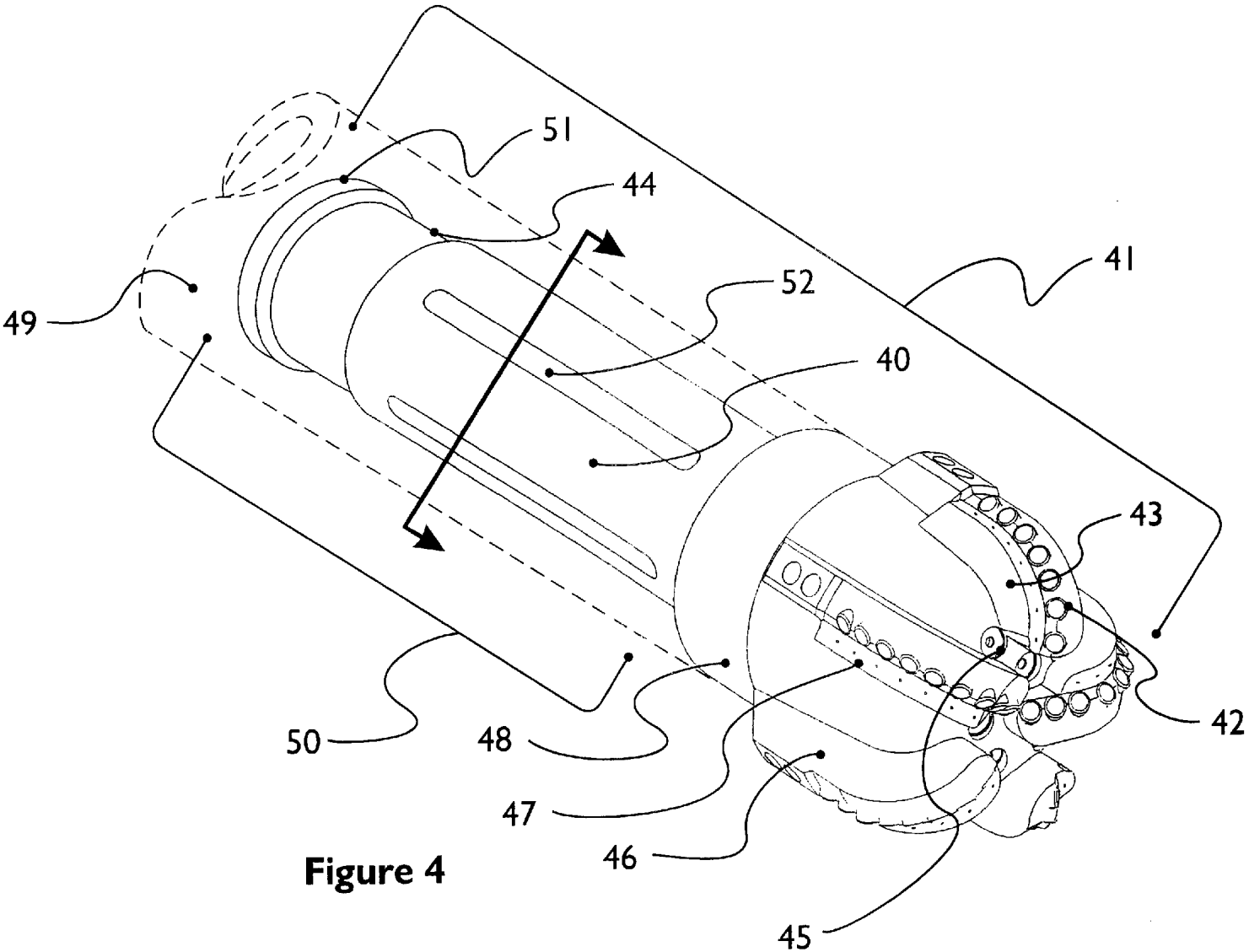
FIG. 4 is a drawing of the preferred embodiment of the percussive shearing bit with cutting elements that can be further enhanced by jets.

FIG. 4 shows the preferred embodiment of the percussive shearing bit. The bit is comprised of a unitary body 41, a means for attachment 50 to the drill string 49, a striking surface 51 to receive impacts from a percussive piston, not shown, located inside the drill string, and a plurality of blades 46 housing a plurality of cutting elements 42. The means for attachment 50 comprises a plurality of keyways 52 (see also FIG. 5) running longitudinally along the shank 40 of the bit body 41. The cylindrical recess 44 accepts a retainer that limits the axial stroke of the bit. Shoulder 48 is positioned up-hole from the blades 46 and faces up-hole, allowing transmission of steady (non-percussive) axial forces from the drill string 49 to the cutting elements 42. Fluid outlets 45 are situated on the head of the unitary body 41 between the blades 46. The blades 46 consist of a series of receptacles to house the cutting elements 42 and a shelf 43 that runs along each blade before the cutting elements. The shelf 43 serves to direct cuttings away from the operative surface of the bit and provides additional surface area for the location of high-pressure fluid outlets 47 that augment the cutting action of the bit.

Figure 5:
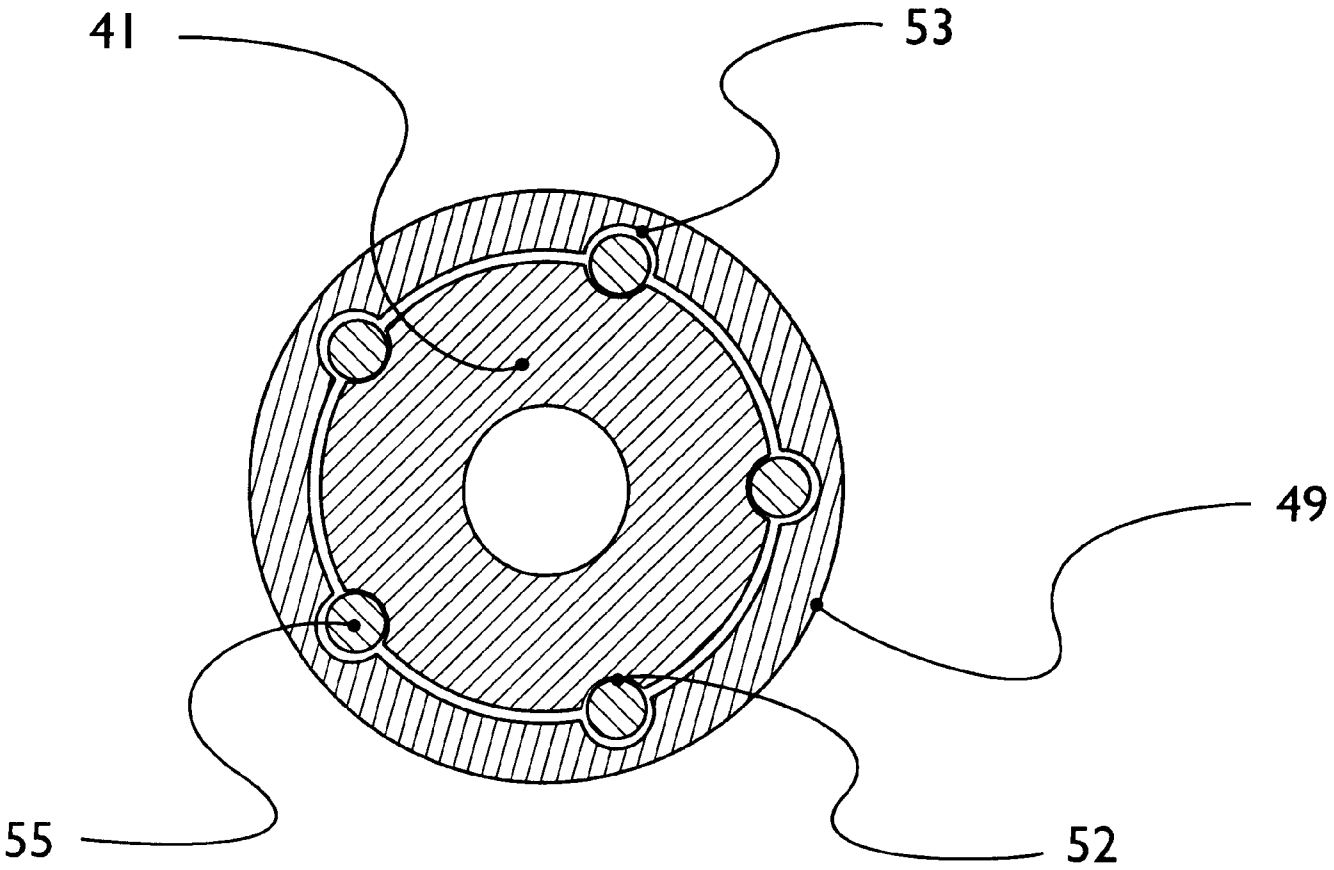
FIG. 5 is a sectioned view of the shank of the percussive shearing bit of FIG. 4; it shows how the drill string can transmit angular torque to the drill bit through the keys and keyways.

FIG. 5. Is a cross section of the means for attachment of the bit body 41 to the drill string 49. The keyways 52 and 53 and the keys 55 are also depicted in cross section. The keys serve to restrict the rotary motion of the bit relative to the drill string without restricting axial motion. The keyways mate the keys. The keys may be spherical, prismatic, or cylindrical in shape. The keys 55, which are most preferably made of a hard metal such as tungsten carbide, also serve to provide a linear bearing surface which guides the axial motion of the unitary bit body 41, and reduces wear of the mating surfaces.

Figure 6A:
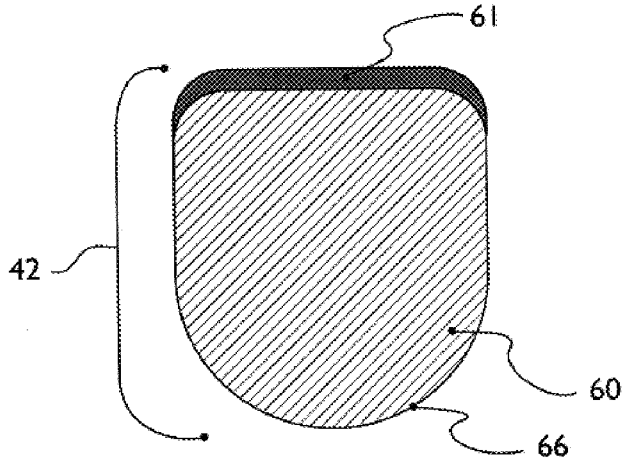
FIG. 6A is a sectioned view of one cutting element without intermediate layers; the figure shows how the cutting table wraps around the top edge of the substrate.
Figure 6C:
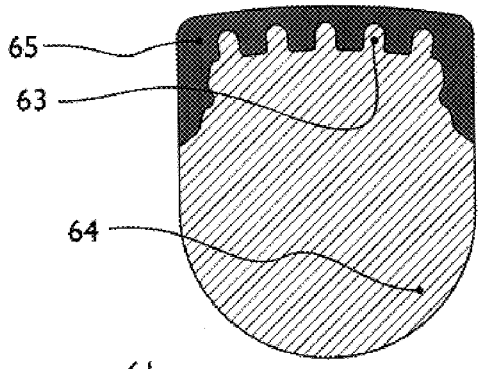
FIG. 6C is a sectioned view of the cutting element of FIG. 6B with the addition of a non-planar interface between the cutting table and the intermediate layers.
Figure 6B:
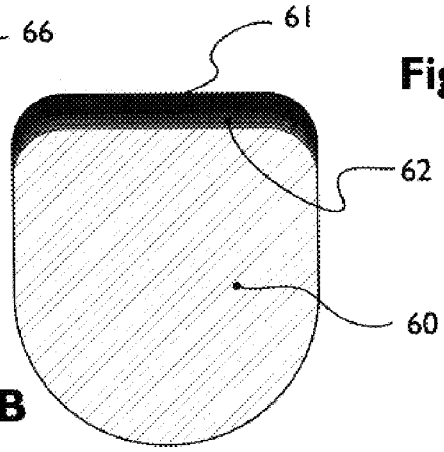
FIG. 6B is a sectioned view of the cutting element of FIG. 6A with the addition of intermediate layers between the cutting table and the substrate.

FIG. 6A shows one of the cutting elements 42, as depicted in FIG. 4. Each of the cutting elements 42 is made up of a substrate 60 and a cutting table 61. The cutting table 61 is comprised of a superhard material such as polycrystalline diamond, thermally stable polycrystalline diamond, or polycrystalline cubic boron nitride. Substrate 60 is most preferably comprised of tungsten carbide. FIG. 6B shows the same cutting element with the addition of one or more intermediate layers 62 between the substrate 60 and the cutting table 61. FIG. 6C depicts a cross section of another embodiment of the cutting element of FIG. 6A with the addition of a non-planar interface 63 between the substrate 64 and the cutting table 65. Each of the cutting elements depicted in FIGS. 6A, 6B, and 6C are configured with a substantially hemispherical or domed distal end 66 that reduces the localized stress associated with the torque and percussive forces applied to bit.

Figure 7A:
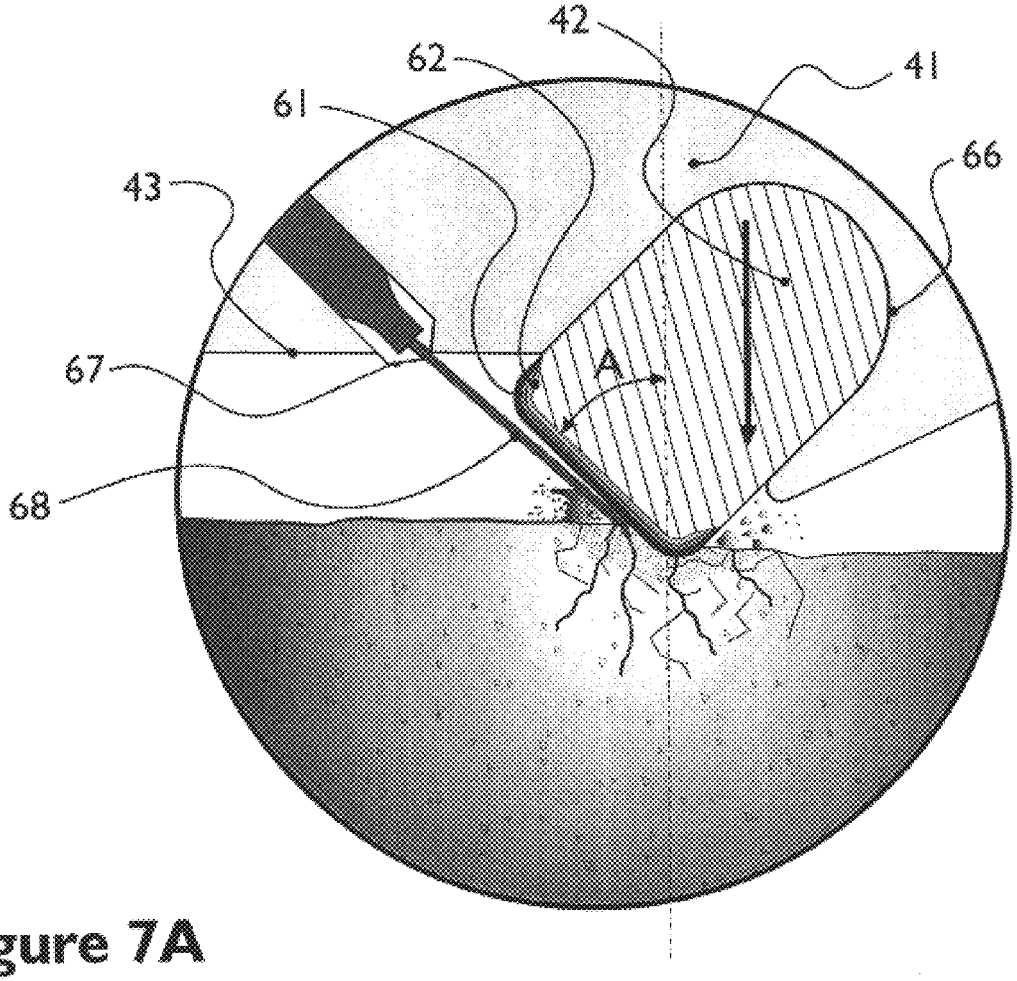
FIG. 7A is a drawing of the cutting element of FIG. 6A, 6B, or 6C seated in the receptacle on the blade; the cutting element is being pressed into the rock by the transient percussive force of the hammer and by the steady force of weight-on-bit. The figure also shows that a jet of fluid can be used to further enhance the penetration by removing crushed rock as the cutter advances and by forcing drilling fluid into the cracks formed by the cutting element.

FIG. 7A is an illustration in cross section of a cutting element 42 of the present invention depicting the percussive action of the bit as it penetrates a subterranean formation. The arrow represents the axial percussive action of the bit. In the most preferred embodiment, the bit body 41 is fitted with a high12 pressure jet nozzle 67 in the shelf 43, for at least a portion of the cutting elements 42. The stream of pressurized fluid 68 is directed to impinge the formation ahead of the cutter 42, and serves to cool the cutter, penetrate the formation, and remove cuttings. The receptacle in the bit body 41 has a domed or hemispherical interior surface in order to mate with the distal end 66 of the cutting element. The domed configuration of the cutting element reduces the stresses induced by the percussive action on the bit along the interface between the bit body and cutting element. The cutting element also features a cutting table 61 (with intermediate layers 62) that wraps around the edge of its working end. As shown, the cutter 42 is mounted with a rake angle a greater than 25°.

Figure 8:
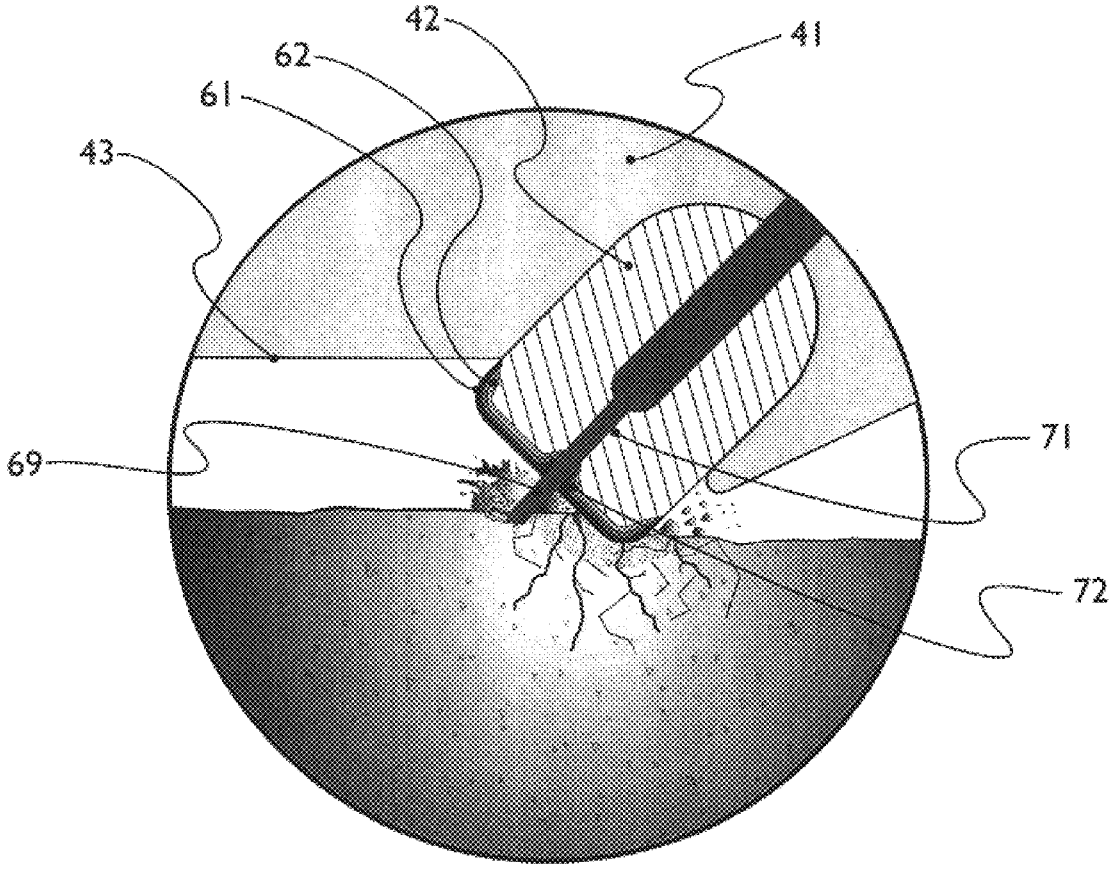
FIG. 8 is a drawing of the cutting element in the blade receptacle with the jet located inside the cutting element. The hole through the cutting element allows the fluid to exit through the cutting table and impinge on the cracks formed by the cutting element.

Alternately, as shown in FIG. 8, the jets 69 can be located inside each cutting element. The orifice 71 through the cutting element 42 allows the high-pressure fluid to exit directly into the rock in contact with the cutting table 61.

The operation of the percussive shear bit will now be described. A rotary motor (not shown) consists of a surface-mounted turntable or top drive motor that turns the entire drill string. Alternately, a down-hole motor powered by the drilling fluid pressure can rotate the bit. The down-hole motor would turn only the lowermost portion of the drill string, including the hammer subassembly. In either case, the rotation of the drill string 49 causes the keys 55 to engage both keyways 52 and 53, thus turning the bit (refer to FIGS. 4 and 5). Placing an axial load on shoulder 48 (via hydraulic piston forces or simply a portion of the weight of the drill string 49) allows crushing and shearing of the rock formation as the drill string rotates. A hammer (also not shown) simultaneously impacts the striking surface 51 of the bit, thereby providing an additional percussive drilling force.

The cutting elements 42 have been specially designed to withstand the unusual stresses induced by combined percussive shear drilling. The larger rake angle minimizes the force that would tend to shear the cutting table 61 from the substrate 60 under percussive impact. At the same time, the larger rake angle presents a sharper, more wedge-like profile to the rock in the axial direction, thus increasing the axially induced stresses in the rock. The rounded distal portion of the cutter 66 prevents large localized stresses in the body of the drill bit by minimizing sharp comers inside the body. The wrap-around cutting element/substrate interface (see FIG. 6A) also helps to keep the cutting table 61 attached and provides a large enough hard surface to keep the substrate 60 from contacting the rock, thereby protecting the substrate 60 against wear. In addition, the wrap-around edge increases the bonding surface area between the cutting table 61 and the substrate 60, thus improving the strength of the bond. The intermediate layers 62 (see FIG. 6B) are composed of composite mixtures of the cutting table and substrate materials; the layers closest to the cutting table 61 have a larger portion of cutting table material so as to have material properties similar to those of the cutting table 61 itself. Similarly, the layers by the substrate 60 have a greater portion of substrate material. As a result, there is a smooth transition in material properties between the cutting table 61 and the substrate 60. This reduces stresses resulting from impact vibrations or differences in thermal expansion rates for the cutting table and substrate materials; a sudden transition between the two materials will cause stresses in the bond zone between them.

The cutting elements 42, under the percussive force, behave as shown in FIG. 7A. The dark arrow represents the force induced by the weight on the bit, which typically ranges from 10,000 to 50,000 pounds, plus the impact force of the hammer. The result of the axial forces is a region of crushed rock directly under the cutting element 42; from the crushed zone, cracks extend deeper into the rock, as shown in FIG. 7A. The jet 68 sprays along the surface of the cutting table 61, thus cooling it and washing away the crushed rock. If the jets are sufficiently powerful, the fluid will also extend into the cracked region to remove additional chips of rock. The jets 68 can operate at the pressure of the fluid inside the bit or they can be intensified and/or pulsed to increase the velocity of the jet flows during penetration.

Figure 7B:
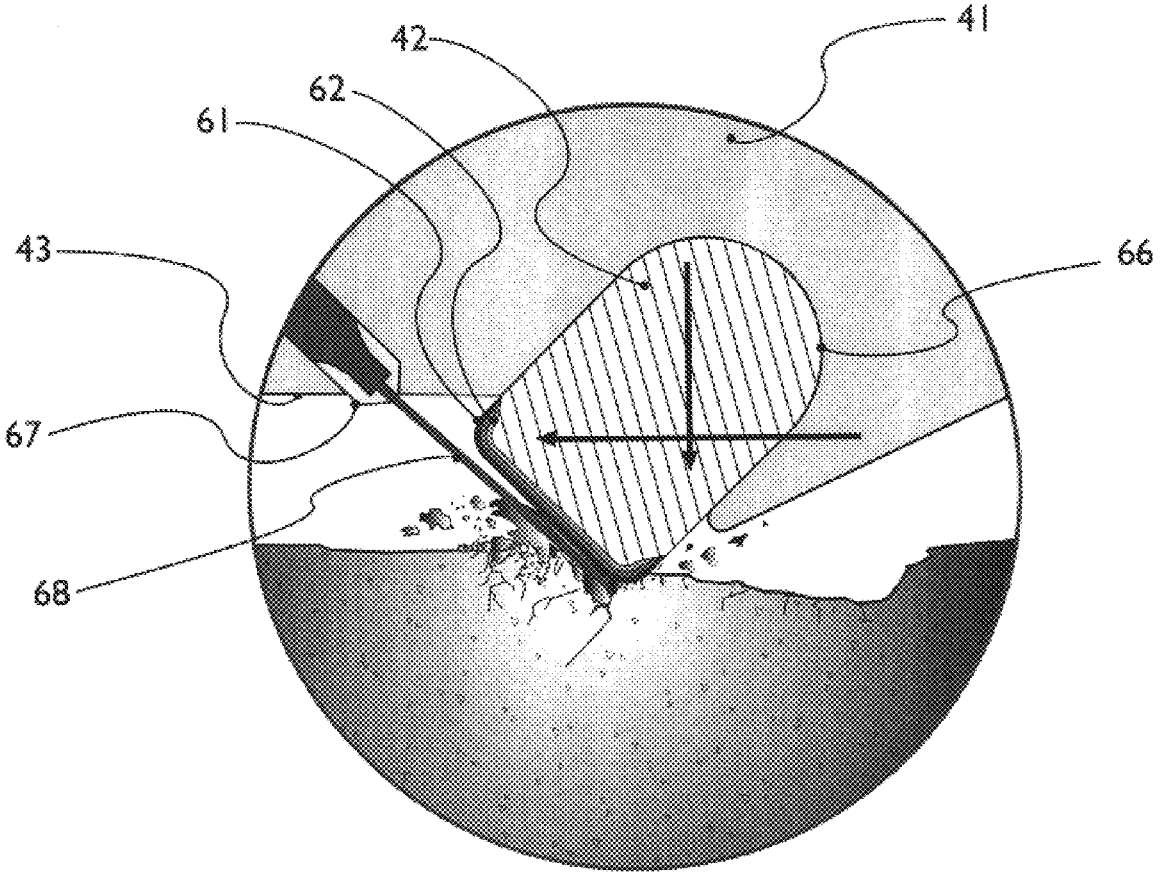
FIG. 7B is a drawing of the cutting element of FIG. 7A as the bit rotates. The cutting element has sheared off some of the rock chips created by the percussive and steady forces of FIG. 7A; the jet simultaneously washes the chips away.

Under the rotary force, the cutting elements will have a shearing action on the rock, as shown by the dark, horizontal arrow of FIG. 7B. This occurs in addition to the force normal to the rock surface, which is now equal to only the steady (non-percussive) axial forces. The shearing action removes chips created by the percussive impact and steady weight on bit. This action, combined with continued jet action, leaves a bare rock surface with little debris.

In addition to the fluid from the jets, drilling fluid also exits the fluid outlets 45 in the head of the bit and moves between the blades 46 towards the shank 40 to further cool the cutting elements 42 and move the chips further up the borehole.

Figure 9:
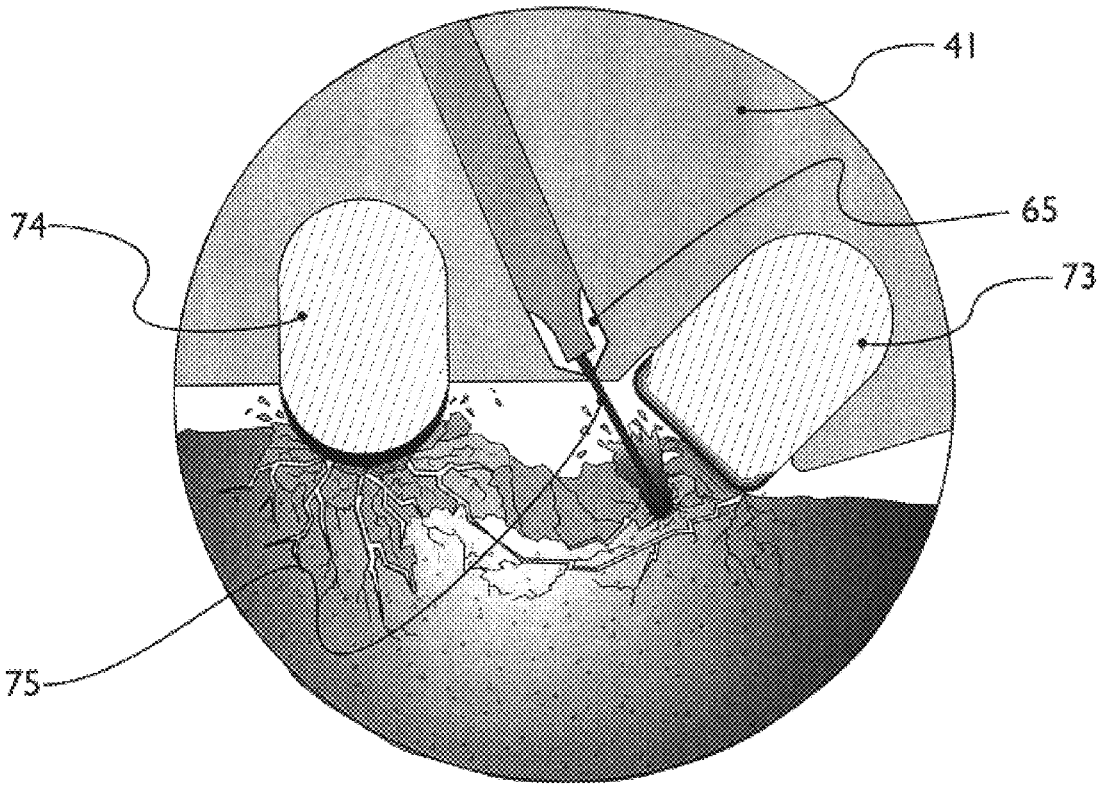
FIG. 9 is a drawing showing combined drilling action similar to that shown in FIGS. 7A and 7B, but where the combined drilling action is accomplished by the synergy of an indenting element, a high-pressure jet, and a percussive shearing cutter.

FIG. 9 depicts an alternative design of bit 41 where the percussive and shearing components of drilling are accomplished by separate cutters, rather than by the same cutter. This alternative design allows cutters to be optimized for the type of drilling action that each predominantly accomplishes. In this figure, axial cutter 74 is optimized for percussive penetration and shear cutter 73 is optimized for shear penetration. High pressure nozzle 65 and jet (Jet) 75 (is) are directed to assist both cutters.

I claim:

1. A percussive shear bit for drilling subterranean formations, comprising:

a. a unitary bit body, comprising a means for attachment to a drill string in such a way that rotational torque and axial weight on bit of between 10,000 and 50,000 pounds can be transferred from the drill string to the unitary bit body, b. a striking surface on the bit body to receive impacts from a percussive piston, c. the unitary bit body further comprising a plurality of shear cutting elements capable of axial loads of between 10,000 and 50,000 pounds disposed about the working surface of the bit body, and d. said cutting elements comprising a shear cutting surface exhibiting a negative rake with respect to the formation being drilled.

2. The percussive shearing bit of claim 1 further comprising a plurality of blades arrayed about the working end of the unitary bit body.

3. The percussive shearing bit of claim 2 wherein the plurality of blades are substantially parabolic in shape and oriented along the longitudinal axis of the working end of the bit.

4. The percussive shearing bit of claim 2 wherein the plurality of blades further comprise a plurality of receptacles having a hemispherical or domed interior surface to mate with the cutting elements.

5. The percussive shearing bit of claim 2 wherein the plurality of blades further comprise shelves oriented so as to lead the cutting elements when the percussive shearing bit rotates.

6. The plurality of blades of claim 5 wherein the shelves further comprise a plurality of fluid jets oriented such that the drilling fluid impinges upon the subterranean formation in the region of the cutting elements.

7. The percussive shear bit of claim 1 wherein the plurality of cutting elements further comprise a fluid jet within the cutting element, itself, in order to direct the flow of drilling fluid so that it impinges the formation in the region of the cutting elements.

8. The percussive shear bit of claim 1 wherein the means for attachment of claim 1 comprising a plurality of longitudinal keyways mating with keys and keyways in the drill string, thereby allowing the unitary bit to slide axially within the drill string, while transmitting rotational torque to the unitary bit.

9. The percussive shear bit of claim 8 wherein the keys are comprised of a hard substance selected form the group consisting of cemented tungsten carbide, silicon carbide, titanium carbide, polycrystalline diamond, and polycrystalline cubic boron nitride.

10. The percussive shear bit of claim 1 wherein the negative rake is not less than 25° with respect to the formation being drilled.

11. The percussive shear bit of claim 1 wherein the negative rake is not greater than 90° with respect to the formation being drilled.

12. A percussive shear bit for drilling subterranean formations, comprising:

a. a unitary bit body, comprising a means for attachment to a drill string in such a way that rotational torque and axial weight on bit of between 10,000 and 50,000 pounds can be transferred from the drill string to the unitary bit body, b. a striking surface on the bit body to receive impacts from a percussive piston, c. the unitary bit body further comprising a plurality of combined cutting elements capable of axial loads of between 10,000 and 50,000 pounds arrayed about the working end of the bit body, d. at least a portion of said cutting elements comprising a non-planar indenting surface, and e. at least a portion of said cutting elements comprising a shear cutting surface exhibiting a negative rake with respect to the formation being drilled.

13. The percussive shearing bit of claim 12 wherein the means for attachment comprises a plurality of lengthwise keyways mating with keys and keyways in the drill string, thereby allowing the unitary bit to slide axially within the drill string, while transmitting rotational torque to the unitary bit.

14. The percussive shearing bit of claim 13 wherein the keys are comprised of a hard substance selected from the group consisting of cemented tungsten carbide, silicon carbide, titanium carbide, polycrystalline diamond, and polycrystalline cubic boron nitride.

15. The percussive shearing bit of claim 12 wherein the negative rake is not substantially less than 25° with respect to the formation being drilled.

16. The percussive shearing bit of claim 12 wherein the negative rake of claim 12 is not greater than 90° with respect to the formation being drilled.

17. The percussive shearing bit of claim 12 wherein the indenting surface of the cutting element further comprises a dome or hemispherical working surface.

18. The percussive shearing bit of claim 12 wherein the unitary bit body further comprises a means for supplying high-pressure drilling fluid to the formation in the region of said cutting elements.

19. The percussive shearing bit of claim 12 wherein the plurality of cutting elements further comprise a fluid jet within the cutting elements in order to direct the flow of drilling fluid so that it impinges the formation in the region of the cutting elements.

* * * * *